United States Patent [19]

Urbansky

[11] 4,242,996

[45] Jan. 6, 1981

[54] IGNITION TIMING CONTROL DEVICE FOR A TURBO-CHARGED INTERNAL COMBUSTION ENGINE

[75] Inventor: Rolf Urbansky, Adenbüttel, Fed. Rep. of Germany

[73] Assignee: Volkswagenwerk Aktiengesellschaft, Wolfsburg, Fed. Rep. of Germany

[21] Appl. No.: 25,750

[22] Filed: Mar. 30, 1979

[30] Foreign Application Priority Data

Apr. 15, 1978 [DE] Fed. Rep. of Germany ..... 2816404

[51] Int. Cl.[3] ..... F02P 5/04

[52] U.S. Cl. ..... 123/407; 123/425

[58] Field of Search ..... 123/117 R, 117 A, 119 ED, 123/119 C

[56] References Cited

U.S. PATENT DOCUMENTS

| | | | |
|---|---|---|---|
| 2,390,166 | 12/1945 | Parkins et al. | 123/117 A |
| 3,521,609 | 7/1970 | Kashiwagi et al. | 123/117 A |
| 3,543,738 | 12/1970 | Barber et al. | 123/117R |
| 3,735,743 | 5/1973 | Shimizu | 123/117 A |
| 3,828,743 | 8/1974 | Ludwig | 123/117 A |
| 3,978,831 | 9/1976 | Yoshikawa | 123/117 R |

FOREIGN PATENT DOCUMENTS

| | | | |
|---|---|---|---|
| 2723046 | 11/1978 | Fed. Rep. of Germany | 123/117 A |

*Primary Examiner*—P. S. Lall

*Attorney, Agent, or Firm*—Brumbaugh, Graves, Donohue & Raymond

[57] ABSTRACT

An ignition timing control device for a turbo-charged internal combustion engine which retards or advances the ignition timing in accordance with the load condition on the engine. The control device acts on a timing adjustment mechanism attached to the distributor to control the ignition timing as a function of the intake manifold pressure. The control device has a housing and a yieldable wall, such as a diaphragm, in the housing forming a pressure chamber on one side thereof. A pressure line is connected to the pressure chamber and opens into the intake manifold at a point swept by the throttle. The manifold pressure, which at that point varies with changes in engine load, is transmitted through the line to the pressure chamber to act on the diaphragm. The diaphragm is coupled to the ignition timing adjustment mechanism so that the timing is advanced or retarded in response to the displacement of the diaphragm. The diaphragm is movable between a neutral position and a retarding position in response to increased pressure in the intake manifold and thereby the pressure chamber to retard the ignition timing, but only when the intake manifold pressure is above a predetermined minimum representing the onset of engine knocking. Preferably, the diaphragm is also movable towards an advancing position in response to negative manifold pressures, representing higher engine speeds and part-load or no-load conditions of the engine, to advance the ignition timing during those operating states.

1 Claim, 1 Drawing Figure

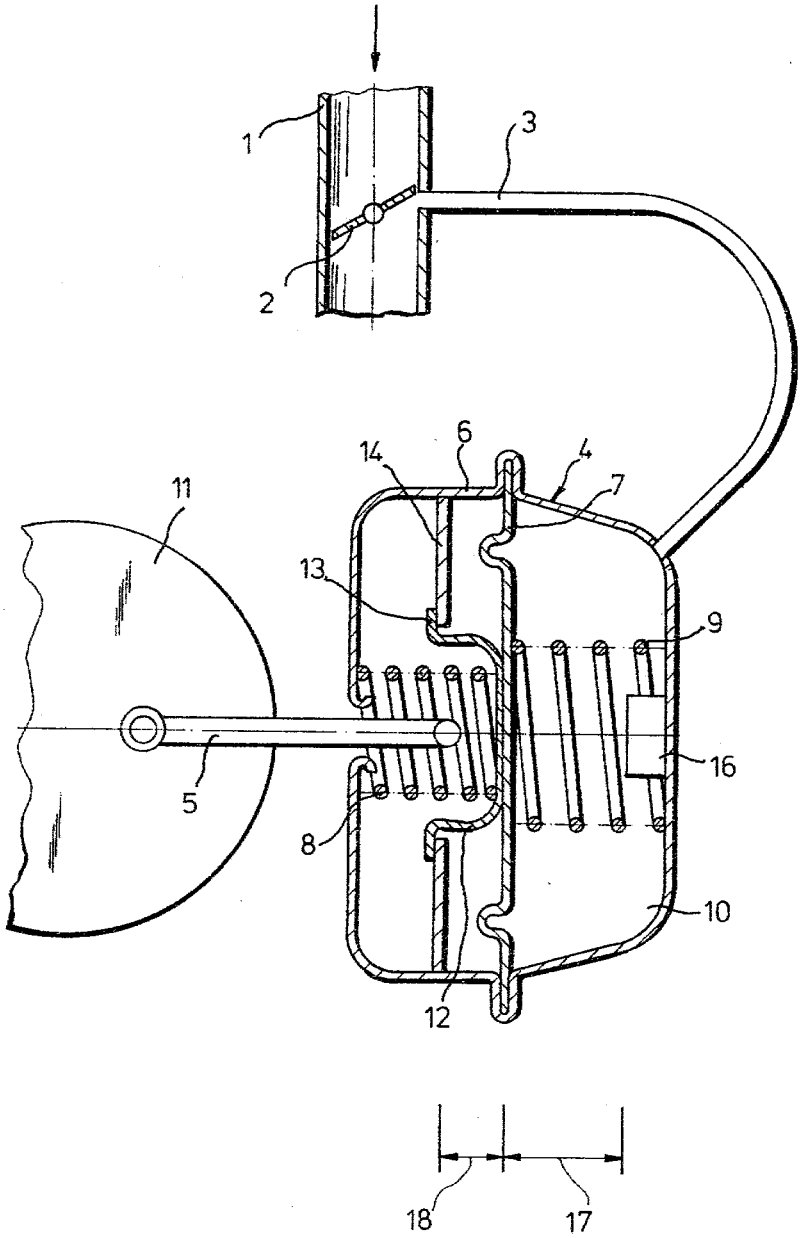
1
2
3
4
5
6
7
8
9
10
11
12
13
14
16
17
18

IGNITION TIMING CONTROL DEVICE FOR A TURBO-CHARGED INTERNAL COMBUSTION ENGINE

BACKGROUND OF THE INVENTION

The invention relates to an ignition timing control device for a turbo-charged internal combustion engine which advances or retards the ignition timing as a function of the pressure in the intake manifold.

The ignition timing in internal combustion engines is normally controlled, in order to obtain optimal operating conditions, as a function of engine speed. It is desirable, however, especially in the case of engines in which air is provided under pressure to the engine cylinder, i.e. turbo-charged engines, that the normal ignition timing be further adjusted depending upon the instantaneous engine load conditions. This is especially desirable when the engine undergoes heavy load, where there would be a danger of pre-ignition. Under these conditions, it is desirable to retard the ignition timing to avoid knocking, even though this compromises the lower fuel consumption attained with advancing the engine timing.

An internal combustion engine of this type is described in U.S. Pat. No. 3,543,738, in which a servomotor acts on an ignition timing adjustment device designed to advance or retard the ignition timing under certain engine operating states. The servomotor is controlled by two comparison devices. One device, responsive to the ratio of engine speed and the pressure in the fuel manifold, provides a signal dependent upon engine load to retard the ignition timing under heavy load. The other controller, providing a control signal responsive to the ratio of the fuel manifold pressure and the air manifold pressure, compensates for lower intake air pressure as would occur when the turbo charger is not fully operative.

SUMMARY OF THE INVENTION

The present invention is an ignition timing control device for a turbo-charged internal combustion engine which is simple in construction, reliable in operation, and designed for a long service life, and at the same time provides the requisite control of the ignition timing advance mechanism to avoid engine knocking at higher loads. The control device is connected to the air intake manifold of the engine, and is actuated in accordance with the instantaneous engine load as measured at a specified point in the manifold.

More particularly, the control device includes a pressure housing, a yieldable wall, such as a diaphragm, in the housing forming a pressure chamber on one side thereof. A pressure line is connected between the pressure chamber and the intake manifold, and opens into the intake manifold at a point in the manifold wall swept by the throttle. Connected in this manner, changes in the manifold pressure, representative of changes in engine load, are transmitted through the line to act on the wall. The wall or diaphragm has at least one portion which is movable between a neutral position and a retarding position in response to increased pressure in the pressure chamber, and is coupled to the distributor timing adjustment mechanism for retarding the ignition timing when the wall is moved from its neutral position towards its retarding position in response to an increase of pressure in the pressure chamber. A spring is also provided acting on the wall for permitting the wall to be displaced towards its retarding position only when the pressure in the intake manifold and thereby the pressure chamber exceeds a pre-determined minimum corresponding to the onset of engine knocking.

The device thereby becomes operative to retard the ignition timing only when the intake manifold air pressure, as measured at a precisely defined point of the intake manifold, namely, at a point swept by the throttle, reaches a value representative of the critical intake pressure (engine load) where engine knocking would otherwise begin. When the air pressure in the intake manifold, and thereby pressure chamber, is below the predetermined minimum, however, the operation of the engine takes place with its normal advanced ignition timing, and thereby achieves the advantages of fuel savings resultant therefrom.

In a preferred form of the invention, the spring which acts on the diaphragm engages a stop mounted within the housing when the diaphragm is at its neutral position, and thus only acts upon the diaphragm when it is moved towards the retarding position.

In a further refinement of the invention, the control device is capable not only of retarding the ignition timing at high engine load, but also of advancing the timing in response to increasing engine speed, to adjust the timing depending upon both the prevailing engine speed and prevailing engine load condition. In this form, the control device 4 would supplement the centrifugal timing advance mechanism in the distributor. This control device can be provided in a relatively small space, avoiding open lines or hoses. In this embodiment of the invention, the diaphragm may be displaceable in the other direction into the pressure chamber, the ignition advancing position, in response to detected negative pressures (vacuum) in the intake manifold and thus pressure chamber. As it is moved toward the advancing position, the diaphragm acts on the timing adjustment mechanism of the distributor to advance the ignition timing. A second spring disposed in the pressure chamber acts in opposition to the movement of the diaphragm towards the advancing position, and thereby provides a control of the ignition advance in accordance with the pressure in the intake manifold and thereby the pressure chamber.

The control device operates to adjust the ignition timing not only at excess pressures but at intake manifold vacuum and can effect a transition from advanced timing to delayed timing, and vice versa, as the load conditions, as represented by the intake manifold pressure, change and can thus be used to control the ignition timing over the entire load range of the engine. At low or partial loads, the diaphragm will be moved toward the advancing position due to the negative intake manifold pressure, and will thus advance the ignition timing. Since the manifold vacuum force increases with increasing engine speed, the ignition timing advance will be proportional to engine speed. Were the engine load to increase, however, the pressure in the intake manifold increases causing a displacement of the diaphragm towards its neutral position, thus reducing the advancement of the ignition timing. With further increase in engine load presenting a danger of engine knocking, the pressure in the intake manifold and thereby pressure will exceed the critical minimum, causing the diaphragm to be displaced towards its retarding position, and the ignition timing to be retarded to avoid pre-ignition problems.

For a better understanding of the invention, reference may be had to the following detailed description of a preferred embodiment thereof, taken in conjunction with the accompanying drawing.

BRIEF DESCRIPTION OF THE DRAWING

The FIGURE represents a longitudinal sectional view, in schematic form, of a control device according to the invention, along with portions of an internal combustion engine illustrating the operation of the control device.

DETAILED DESCRIPTION OF A PREFERRED EMBODIMENT

In the drawing, a portion of the intake manifold 1 of the engine is shown, with a throttle 2 pivotally contained within the manifold 1. A turbo-charging device, not shown, directs intake air under pressure through the manifold 1, the direction of airflow indicated by the arrow, toward the cylinders of the engine. The internal combustion engine may be a reciprocating piston internal engine, or a rotary piston engine, including an ignition distributor with a conventional timing adjustment mechanism 11 to advance or retard the ignition timing.

A control device 4 is connected between the intake manifold 1 and the ignition timing advancing mechanism 11 to control the ignition timing in response to the pressure in the intake manifold 1. The control device 4 has a pressure housing 6 and a yieldable wall, such as a diaphragm 7, in the housing 6 forming a pressure chamber 10 on one side thereof. Alternatively, the diaphragm 7 could be a displaceable piston. A pressure line 3 is connected between the pressure chamber 10 and the intake manifold 1, and opens into the intake manifold at a point in the manifold wall swept by the throttle 2. Thus the instantaneous pressure which at that point in the manifold will vary as a function not only of increasing engine speed (increasing vacuum), but of increased load (increased pressure, as throttle opens, due to a decreased pressure drop across the throttle) is transmitted through the line 3 to the pressure housing 10 to act on the diaphragm. Preferably, the pressure line 3 is connected to the manifold at a point so that at idling, with the throttle 2 closed, air pressure in the line 3 (and thereby pressure chamber 10) will not move the diaphragm 7 from in its neutral position, which is shown in the FIGURE. Changes in manifold pressure will thus tend to move the diaphragm 7 from its neutral position to the right (vacuum) or left (excess pressure). Movement of the diaphragm 7 is, in turn, transmitted to the ignition timing mechanism 11 by a coupling rod 5 connected between the ignition timing adjustment mechanism 11 and the diaphragm 7.

In the embodiment shown, the diaphragm 7 is displaceable from a neutral position, shown in the FIGURE, toward a retarding position, in which it is moved toward the left against the force of a spring 8, to act on the timing adjustment mechanism 11 to retard the ignition timing.

Thus, with increased pressure in the intake manifold and thus the pressure chamber, corresponding to higher load, the diaphragm 7 is forced toward this retarding position (toward the left) against the spring 8. The spring 8 is designed so that in the case of high partial loads and full load, that is, when a comparatively high pressure is present in the intake manifold and thereby the pressure chamber 10, it will permit the diaphragm to be displaced toward the retarding position. Preferably, however, the spring 8 is designed so that initial displacement is permitted only when the air pressure and the intake manifold 1 attains a predetermined minimum value corresponding to the onset of engine knocking.

The pressure housing 6 also carries a stop 14, which engages the flanged edge 13 of a spring plate 12 when the diaphragm 7 is in its neutral position. Thus, if the diaphragm 7 were to be moved further toward the right, the spring 8 would no longer act upon the diaphragm, but would rest against the spring plate 12 held in turn by the stop 14.

In the preferred form of the device, the diaphragm 7 is also being capable of moving from its neutral position towards the right, that is, toward an ignition advancing position. The diaphragm 7 is drawn toward the ignition advancing position when negative pressures exist in the intake manifold 1, and especially in the case of higher vacuum pressures corresponding to minimal load on the engine at higher RPM. The connecting rod 5 is simultaneously displaced to cause the ignition timing adjustment mechanism 11 to advance the ignition timing. A second spring 9 is disposed in the pressure chamber 10 to control the movement of the diaphragm 7 towards the advancing position, but preferably has a smaller resistance force than the spring 8. A second stop 16 may be positioned in the housing to limit the movement of the diaphragm 7 towards the advancing position and thus control the maximum ignition timing advance.

The control device 4 according to the invention is capable of both advancing or retarding the normal ignition timing of the engine in accordance with the particular speed and load conditions of the engine as represented by the pressure in the intake manifold 1. Under normal part-load to no-load conditions, as engine speed increases the vacuum in the intake manifold 1 downstream of the throttle 2 will increase accordingly. The increasing suction force is transmitted through the pressure line 3 to the pressure chamber to draw the diaphragm 7 toward the timing advance position 17, with the amount of displacement dependent upon the amount of vacuum present (engine speed). As the diaphragm 7 is displaced, the timing adjustment mechanism responds and advances the ignition timing proportionally.

At any given speed, where the timing has been so adjusted, if the engine were to experience high loads, it would be desirable to retard the ignition timing to prevent knocking. Such higher loads, however, will be represented by excess pressure in the manifold 1. The higher pressure in the intake manifold 1 will be transmitted to the pressure housing 10 to displace the diaphragm 7 toward the left to the retarding position, designated 18. Thus for all operating conditions of the engine, the ignition will be adjusted to its optimum timing to account for both engine r.p.m. and load.

Alternatively, the negative pressure adjustment of the control device 4 may be eliminated and the control device provide only the retarding mechanism responsive to the intake manifold pressure. In such a case, the ignition timing advance in accordance with engine speed would be determined solely by the centrifugal adjustment control in the distributor, and would not be supplemented by the instantaneous intake manifold vacuum.

Although the invention has been shown and described with reference to certain preferred embodiments, it will be understood that variations and modifications will be apparent to those skilled within the art, while remaining within the inventive priciples disclosed herein. All such variations and modifications are intended to be within the scope of the present invention, as defined in the following claims.

I claim:

1. In a turbo-charged internal combustion engine having an ignition distributor, a throttle valve pivotally contained within the intake manifold of the engine, and an adjustment device acting on the distributor for advancing or retarding the ignition timing, the improvement comprising control means for adjusting the ignition timing as a function of the intake manifold pressure, said control means including a pressure housing, a yieldable wall in said housing forming a pressure chamber on one side thereof, a pressure line connected between said pressure chamber and said intake manifold and opening into said manifold at a point swept by the throttle, wherein changes in manifold pressure are transmitted through said line to said pressure chamber to act on said wall, at least a portion of said wall movable from a neutral position to a retarding position in response to increased pressure in said pressure chamber and to a timing advance position in response to negative pressures in said intake manifold and thereby said pressure chamber, coupling means between said wall and said adjustment device for retarding the ignition timing in response to displacement of said wall from said neutral position toward said retarding position and for advancing the ignition timing in response to displacement of said wall toward said advancing position, biasing means acting on said wall for permitting said wall to be moved toward said retarding position only when the pressure in the intake manifold, and thereby the pressure chamber, exceeds a predetermined minimum corresponding to the onset of engine knocking, wherein said biasing means comprises a first spring, and said housing includes stop means arranged so that said first spring engages the stop means when said wall is in the neutral position or the timing advance position, and said first spring engages said wall to act in opposition to the movement of said wall only when said wall is moved from said neutral position toward the retarding position, and further comprising a second spring acting on said wall in opposition to movement of said wall toward said timing advance position.

* * * * *